US008049687B2

(12) United States Patent
Kim

(10) Patent No.: US 8,049,687 B2
(45) Date of Patent: Nov. 1, 2011

(54) ORGANIC ELECTROLUMINESCENT DISPLAY DEVICE INCLUDING UPPER AND LOWER DISPLAY AREAS AND DRIVING METHOD THEREOF

(75) Inventor: Seong-Gyun Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 848 days.

(21) Appl. No.: 11/298,026

(22) Filed: Dec. 8, 2005

(65) Prior Publication Data

US 2006/0145963 A1 Jul. 6, 2006

(30) Foreign Application Priority Data

Dec. 30, 2004 (KR) ..... 10-2004-0116196

(51) Int. Cl.
*G09G 3/32* (2006.01)

(52) U.S. Cl. ..... 345/82; 345/532

(58) Field of Classification Search ..... 345/45, 345/87, 204, 76–77, 82–83, 532, 536; 315/169.3; 313/463
See application file for complete search history.

(56) References Cited

U.S. PATENT DOCUMENTS 4,745,485 A 5/1988 Iwasaki
5,422,654 A 6/1995 Tjandrasuwita et al.
5,815,135 A * 9/1998 Yui et al. ..... 345/97
5,898,442 A * 4/1999 Takebe ..... 345/531
5,929,832 A * 7/1999 Furukawa et al. ..... 345/98
2002/0047956 A1 4/2002 Kawashima

FOREIGN PATENT DOCUMENTS

| | | |
|---|---|---|
| JP | 03-043783 | 2/1991 |
| JP | 08-278486 | 10/1996 |
| JP | 09-101765 | 4/1997 |
| JP | 2003-043783 | 2/2003 |
| JP | 2004/117441 | 4/2004 |

OTHER PUBLICATIONS

The search report for corresponding European Patent Application No. 05027212.2.
Office Action issued in corresponding Japanese Patent Application No. 2005-371841; mailed May 27, 2009.
Office Action issued in corresponding Japanese Patent Application No. 2005-371841; mailed Sep. 30, 2009.

* cited by examiner

*Primary Examiner* — Chanh Nguyen
*Assistant Examiner* — Long Pham
(74) *Attorney, Agent, or Firm* — Brinks Hofer Gilson & Lione

(57) ABSTRACT

A method of driving a display device includes outputting an upper data signal array of a $(n+1)^{th}$ frame to an upper display area of a display panel during a first frame period; and, outputting a lower data signal array of a $n^{th}$ frame to a lower display area of the display panel during the first frame period is provided. The display panel has at least an upper display area and a lower display area which may be independently operable, the display areas communicating with a memory device storing and outputting a signal data array of a $(n+1)^{th}$ frame to an upper display area of a display panel during a first frame period; and, outputting a lower data signal array of a $n^{th}$ frame to a lower display area of the display panel during the first frame period.

12 Claims, 6 Drawing Sheets

ORGANIC ELECTROLUMINESCENT DISPLAY DEVICE INCLUDING UPPER AND LOWER DISPLAY AREAS AND DRIVING METHOD THEREOF

The present application claims the benefit of Korean Patent Application No. 2004-0116196, filed in Korea on Dec. 30, 2004, which is hereby incorporated by reference for all purposes as if fully set forth herein.

TECHNICAL FIELD

The present application relates to an organic electroluminescent display device, and more particularly, to an organic electroluminescent display (OELD) device and a method of driving an OELD device.

BACKGROUND

Display devices have employed cathode-ray tubes (CRT) to display images. However, various types of flat panel displays, such as liquid crystal display (LCD) devices, plasma display panel (PDP) devices, field emission display (FED) devices, and electro-luminescent display (ELD) devices, are currently being developed as substitutes for the CRT. Among these various types of flat panel displays, LCD devices have advantages of thin profile and low power consumption, but have disadvantages of using a backlight unit because they are non-luminescent display devices. However, as organic electroluminescent display (OELD) devices are self-luminescent display devices, they are operated at low voltages and have a thin profile. Further, the OELD devices have advantages of fast response time, high brightness and wide viewing angles.

In a related art OLED shown in FIG. 1, a plurality of gate lines G1, G2, . . . , and Gm are extended along a first direction, and a plurality of data lines D1, D2, . . . , and Dn are extended along a second direction perpendicular to the first direction. The gate and data lines define respective pixel regions arranged in a matrix form. In each pixel region, a switching thin film transistor P1, a storage capacitor C1, a driving thin film transistor P2 and an organic electroluminescent diode OED are disposed. The switching and driving thin film transistors P1 and P2 include p-type thin film transistors.

Gate electrodes of the switching thin film transistors P1 are connected to the respective gate lines G1, G2, . . . , and Gm, and the source electrodes of the switching thin film transistors P1 are connected to the respective data lines D1, D2, . . . , and Dn. A first electrode of the storage capacitor C1 is connected to a drain electrode of the switching thin film transistor P1, and a second electrode of the storage electrode C1 is connected to a power terminal Vdd. Source electrodes of the driving thin film transistor P2 are connected to the power terminal Vdd, the gate electrodes of the driving thin film transistors P2 are connected to the respective drain electrodes of the switching thin film transistors P1, and drain electrodes of the driving thin film transistors P2 are connected to the respective first electrodes of the organic electroluminescent diodes OED. The second electrode of the organic electroluminescent diode OED is connected to a ground terminal.

An "on" gate signal is applied to a selected gate line GS1, G2, . . . , or Gm, and the switching thin film transistor P1 connected to the selected gate line G1, G2, . . . , or Gm is turned on. When the switching thin film transistor P1 is turned on, a data signal is charged on the storage capacitor C1. The charged data signal is applied to the gate electrode of the driving thin film transistor P2 and adjusts an "on" current in the driving thin film transistor P2. In response to the "on" current, the organic electroluminescent diode OED emits light. In this manner, the respective organic electroluminescent diodes "OED" emit light when the respective gate lines G1, G2, . . . , and Gm are sequentially selected.

As the size of the OELD device increases, the gate and data lines have longer paths. Accordingly, a resistance-capacitance (RC) delay of the signal lines having long paths increases, and distortion of display images occurs.

One means of solving the problem of distortion of the display images, where the display area is subdivided and each of the subdivided areas is operated by a separate driving circuit, has been suggested.

FIG. 2 is a conceptual view of an OELD device having a subdivided display area. A display area is divided into a first to a sixth six sub-area, S1-S6. The first to sixth sub-areas are operated independently from one another by using corresponding data driving circuits S1-DATA through S6-DATA and corresponding gate driving circuits S1-SCAN through S6-SCAN. Although not shown in FIG. 2, gate driving circuits for the second and fifth sub-areas S2 and S5 are also provided.

A driving circuit control portion (not shown) controls the driving circuits S1-DATA through S6-DATA and S1-SCAN through S6-SCAN. Data signals are supplied to the driving circuit control portion having a memory device, and the memory device stores the data signals. Data signals of one frame for one display image are divided into six arrays corresponding to the six sub-areas S1 through S6. The driving circuit control portion outputs each array of the data signals to the corresponding data driving circuits S1-DATA through S6-DATA. Each data driving circuit S1-DATA through S6-DATA simultaneously outputs the corresponding array of the data signals of one frame to the corresponding sub-areas S1 through S6. In each of the sub-areas S1 through S6, the data signals are applied to pixel regions along the data line sequentially according to scanning the gate lines of each sub-area S1 through S6 by each gate driving circuit S1-SCAN to S6-SCAN, resulting in the display of an image.

This method of driving a subdivided display area is applicable to an LCD device, but problematic for an OELD device having a fast response time. In particular, method is problematic for the large sized OELD device, as a display image is displayed discontinuously at boundary portions between an upper sub-area and a lower sub-area.

FIG. 3 is a progressive view illustrating a method of driving a bifurcated display area of an OELD device, and FIG. 4 is a block diagram illustrating a transfer flow of data signals in a driving circuit control portion of an OELD device of FIG. 3.

As shown in FIGS. 3 and 4, a display area of the OELD device includes an upper sub-area U and a lower sub-area L. A moving image moves from a first position A to a second position B. In FIG. 3, movement of the moving image is shown sequentially with four steps, ST1 through ST4. Although not shown in FIG. 3, the upper sub-area U is operated by an upper data driving circuit and an upper gate driving circuit, and the lower sub-area L is operated by a lower data driving circuit and a lower gate driving circuit. Each of the sub-areas is scanned from the top to the bottom thereof.

A driving circuit control portion 10 is supplied with data signals of one frame and simultaneously outputs divided upper and lower data signal arrays of one frame into corresponding upper and lower data driving circuits.

In detail, the driving circuit control portion 10 is supplied with data signals of a $(n-1)^{th}$ frame, and the data signals of the $(n-1)^{th}$ frame are divided into an upper data signal array and an lower data signal array. The upper and lower data signal arrays of the $(n-1)^{th}$ frame are outputted to the upper and lower data driving circuits and supplied to the upper and lower sub-areas U and L, respectively. Subsequently, data signals of a next frame, i.e., a $n^{th}$ frame, are supplied to the driving circuit control potion 10, divided and outputted to the upper and lower sub-areas U and L.

The moving image of the first position A is displayed when the upper and lower data arrays of the $(n-1)^{th}$ frame are written on the entire upper and lower sub-areas U and L, respectively. Then, in the first step ST1 corresponding to a first quarter of the nth frame period, an upper portion of the moving image of the lower sub-area L moves to the second position B, but the other portions of the moving image do not yet move. Then, in the second step ST2, between the first quarter and a second quarter of the $n^{th}$ frame period, a lower portion of the moving image of the lower sub-area L moves to the second position B. Then, in the third step ST3, the second quarter and a third quarter of the $n^{th}$ frame period, an upper portion of the moving image of the upper sub-area U moves to the second position B. Then, in the fourth step ST4, during the third quarter and a fourth quarter of the $n^{th}$ frame period, a lower portion of the moving image of the upper sub-area U moves to the second position B.

When the display area is divided into the upper and lower sub-areas and the two sub-areas are operated simultaneously with the data signals of the same frame and independently from each other, the moving image displayed across the boundary portion between the upper and lower sub-areas moves unnaturally because of the fast response time of the OELD device. Therefore, an observer perceives an unnatural movement of the moving image across the boundary, as if the display image of the present frame overlaps that of the previous frame.

SUMMARY

A method of driving a display device is disclosed including outputting an upper data signal array of a $(n+1)^{th}$ frame to an upper display area of a display panel during a first frame period; and, outputting a lower data signal array of a nth frame to a lower display area of the display panel during the first frame period.

In another aspect, a display device includes a display panel having upper and lower display areas; and, a driving circuit control portion supplying an upper data signal array of a $(n+1)^{th}$ frame to the upper display area during a first frame period and supplying a lower data signal array of a nth frame to the lower display area during the first frame period.

DETAILED DESCRIPTION

Exemplary embodiments may be better understood with reference to the drawings, but these examples are not intended to be of a limiting nature. Like numbered elements in the same or different drawings perform equivalent functions.

Figure 5:
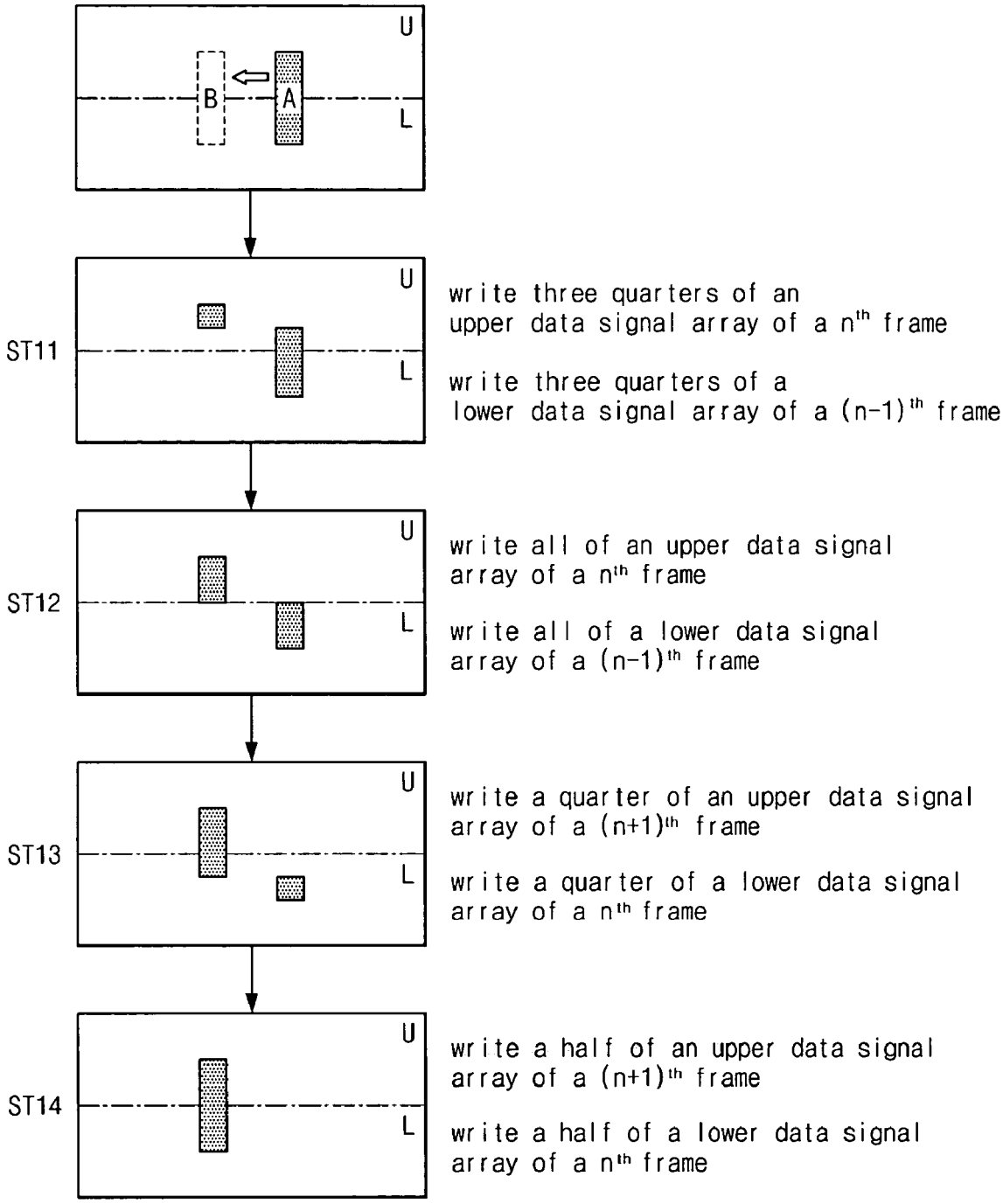
FIG. 5 is a progressive view illustrating a method of driving a bifurcated display area of the OELD device according to an exemplary embodiment.
Figure 6:
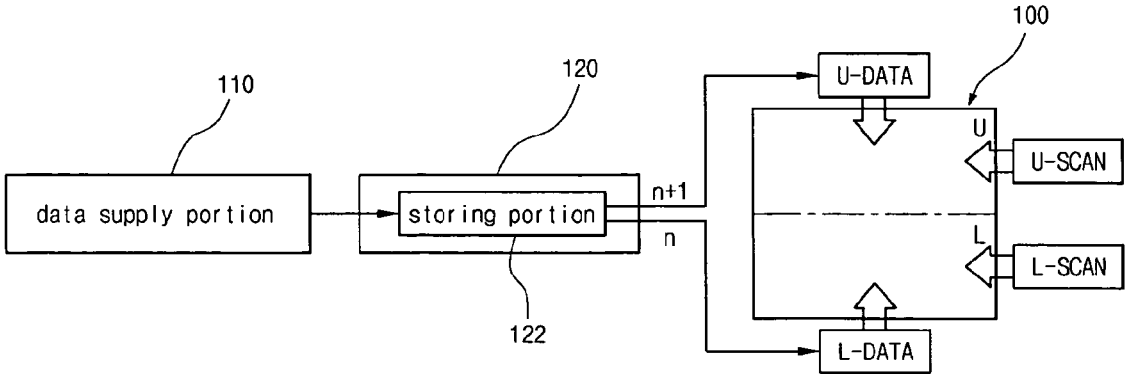
FIG. 6 is a view illustrating a OELD device according to an exemplary embodiment.
Figure 7:
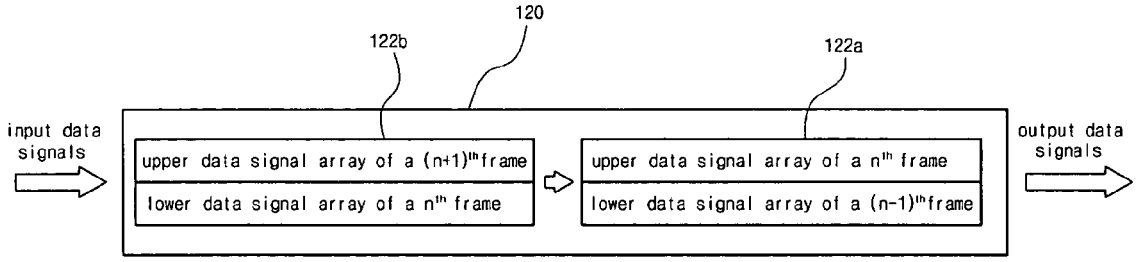
FIG. 7 is a block diagram illustrating a transfer flow of data signals in a driving circuit control portion of an OELD device of FIG. 6.

As shown in FIGS. 5 to 7, a display area of the OELD includes an upper sub-area U and a lower sub-area L. Upper and lower data signals are simultaneously written on upper and lower sub-areas U and L, respectively, from a top side to a bottom side thereof. In other words, gate lines, which are extended along a first direction, in each of the upper and lower sub-areas U and L are scanned from the top side to the bottom side along a second direction along which the data lines extend. Accordingly, the upper and lower data signals are simultaneously written on the upper and lower sub-areas U and L, respectively, from the top side to the bottom side.

In FIG. 5, movement of the moving image is shown in four sequential steps, ST11 through ST14. The upper sub-area U is operated by an upper data driving circuit U-DATA and an upper gate driving circuit U-SCAN, and the lower sub-area L is operated by a lower data driving circuit L-DATA and a lower gate driving circuit L-SCAN.

The upper and lower sub-areas U and L simultaneously display corresponding upper and lower images according to a timing sequence, and thus one display image is displayed during one frame period. In particular, during a first frame period, while upper data signal array of a $n^{th}$ frame are written on the upper sub-area U, lower data signal array of a $(n-1)^{th}$ frame are written on the lower sub-area L. In this manner, writing of the lower data signal array of a present frame on the lower sub-area L and the upper image data signal array of a next frame on the upper sub-area U is conducted continuously.

In more detail, in the first step ST11 between a start point and a third quarter of the first frame period, three quarters of the upper data signal arrays of the nth frame are written on the upper sub-area U and three quarters of the lower data signal arrays of the $(n-1)^{th}$ frame are written on the lower sub-area L. Accordingly, three quarters of the upper sub-area U are updated so that an upper portion of the moving image of the upper sub-area U moves from the first position A to the second position B, and three quarters of the lower sub-area L are updated so that the moving image of the lower sub-area L are displayed at the first position A.

Then, in the second step ST12, between the third quarter and a fourth quarter of the first frame period, a residual fourth quarter of the upper data signal arrays of the $n^{th}$ frame are written on the upper sub-area U and a residual fourth quarter of the lower data signal arrays of the $(n-1)^{th}$ frame are written on the lower sub-area L. Accordingly, a residual fourth quarter of the upper sub-area U is updated so that a lower portion of the moving image of the upper sub-area U moves from the first position A to the second position B, and a residual fourth quarter of the lower sub-area L is updated so that the moving image of the lower sub-area L still remains at the first position A.

In other words, during the first and second steps ST11 and ST12, all of the upper data signal arrays of the nth frame are written on the entire upper sub-area U and all of the lower data signal arrays of the $(n-1)^{th}$ frame are written on the entire lower sub-area L. Accordingly, the entire upper sub-area U are updated so that the moving image of the upper sub-area U moves from the first position A to the second position B, and the entire lower sub-area L is updated so that the moving image of the lower sub-area L is displayed at the first position A.

Subsequently, in the third step ST13 , between a start point and a first quarter of a second frame period, a first quarter of the upper data signal arrays of a $(n+1)^{th}$ frame are written on the upper sub-area U and a first quarter of the lower data signal arrays of the nth frame are written on the lower sub-area L. Accordingly, a first quarter of the upper sub-area U is updated so that the moving image of the upper sub-area U remains at the second position B, and a first quarter of the lower sub-area L is updated so that an upper portion of the moving image of the lower sub-area L moves from the first position A to the second position B.

Then, in the fourth step ST14, between the first quarter and a second quarter of the second frame period, a second quarter of the upper data signal arrays of the $(n+1)^{th}$ frame are written on the upper sub-area U and a second quarter of the lower data signal arrays of the $n^{th}$ frame is written on the lower sub-area L. Accordingly, a second quarter of the upper sub-area U is updated so that the moving image of the upper sub-area U remains at the second position B, and a second quarter of the lower sub-area L is updated so that an lower portion of the moving image of the lower sub-area L moves from the first position A to the second position B.

In other words, during the third and fourth steps ST13 and ST14, a first half of the upper data signal array of the $(n+1)^{th}$ frame is written on the half upper sub-area U and a first half of the lower data signal array of the $n^{th}$ frame is written on the half lower sub-area L. Accordingly, the half upper sub-area U is updated so that the moving image of the upper sub-area U is still displayed at the second position B, and the half lower sub-area L is updated so that the moving image of the lower sub-area L moves from the first position A to the second position B.

As a result, during the first to fourth steps ST11 to ST14, the moving image across the boundary between the upper and lower sub-areas U and L moves from the first position A to the second position B without unnaturalness, by supplying the upper sub-area U with the data signals which are next to the data signals supplied to the lower sub-area L.

To operate the display area described above, the OELD device includes a display panel 100, gate driving circuits U-SCAN and L-SCAN, data driving circuits U-DATA and L-DATA and a driving circuit control portion 120. In the display panel 100, the display area is divided into the upper and lower sub-areas U and L. The upper sub-area U is operated by the upper gate driving circuit U-SCAN and the upper data driving circuit U-DATA, and the lower sub-area L is operated by the lower gate driving circuit L-SCAN and the lower data driving circuit L-DATA. Accordingly, the upper and lower sub-areas U and L are displayed simultaneously and operated independently from each other.

The driving circuit control portion 120 includes a storing portion 122. The driving circuit control potion 120 is supplied with data signals from a data supply portion 110 such as a video card. Upper and lower data signal arrays to display one display image at the same time are sequentially stored in the storing portion 122 and outputted to the corresponding data driving circuits U-SCAN and L-SCAN, respectively. The upper and lower data signal arrays correspond to the upper data signal array of the $(n+1)^{th}$ frame and the lower data signal array of the $n^{th}$ frame, respectively.

The storing portion 122 may have first and second memory devices to store the upper and lower data signal arrays. For example, the storing portion 122 may include a first memory device 122*a* storing the upper and lower data signal arrays to display a present display image, and a second memory device 122*b* storing the upper and lower data signal arrays to display a next display image. Each of the first and second memory devices 122*a* and 122*b* may include an upper sub-memory device and a lower sub-memory device storing the upper and lower data signal arrays, respectively. The upper sub-memory device stores the upper data signal array of a frame which is next to a frame of the lower data signal array stored in the lower sub-memory device. When the upper and lower data signal arrays of the first memory device 122*a* have been entirely output, the upper and lower data signal arrays of the second memory device 122*b* are transferred to and stored in the first memory device 122*a*. In this manner, the first and second memory devices 122*a* and 122*b* repeatedly store and output the upper and lower data signal arrays. In addition, a plurality of first memory devices 122*a* may be used. The plurality of first memory devices 122*a* may be arranged in parallel and sequentially output the upper and lower data signal arrays to display the corresponding display images.

In addition, the storing portion 122 may include a plurality of third memory devices each storing data signals of one frame. Among data signals of one frame in the third memory device, the upper and lower data signal arrays are abstracted and stored in the second memory device 122*b*. It should be understood that the storing portion 122 may have different structures to output the upper and lower data signal arrays to the upper and lower data driving circuits U-DATA and L-DATA, respectively.

In the exemplary embodiment the OELD device is used as an example. However, it should be understood that the present invention is applicable to other display devices having sub-divided areas independently operable.

Figure 1:
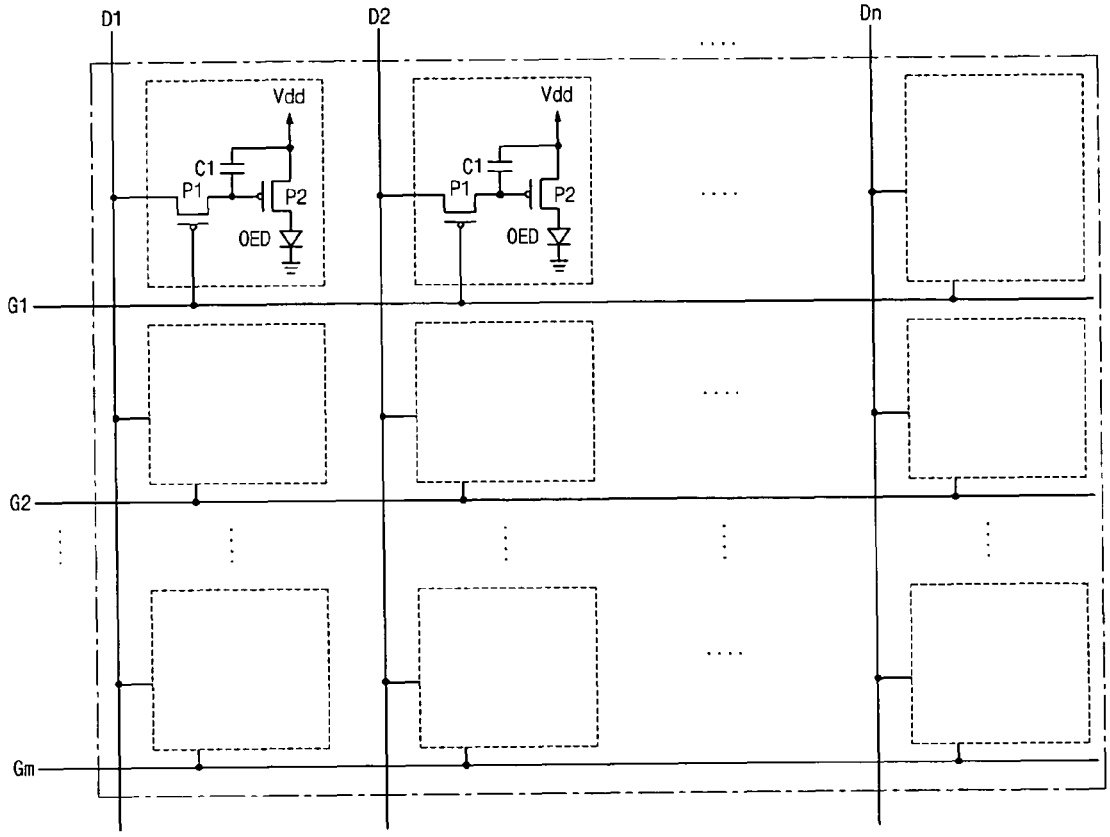
FIG. 1 RELATED ART
FIG. 1 is a circuit diagram of an OELD device according to the related art.
Figure 2:
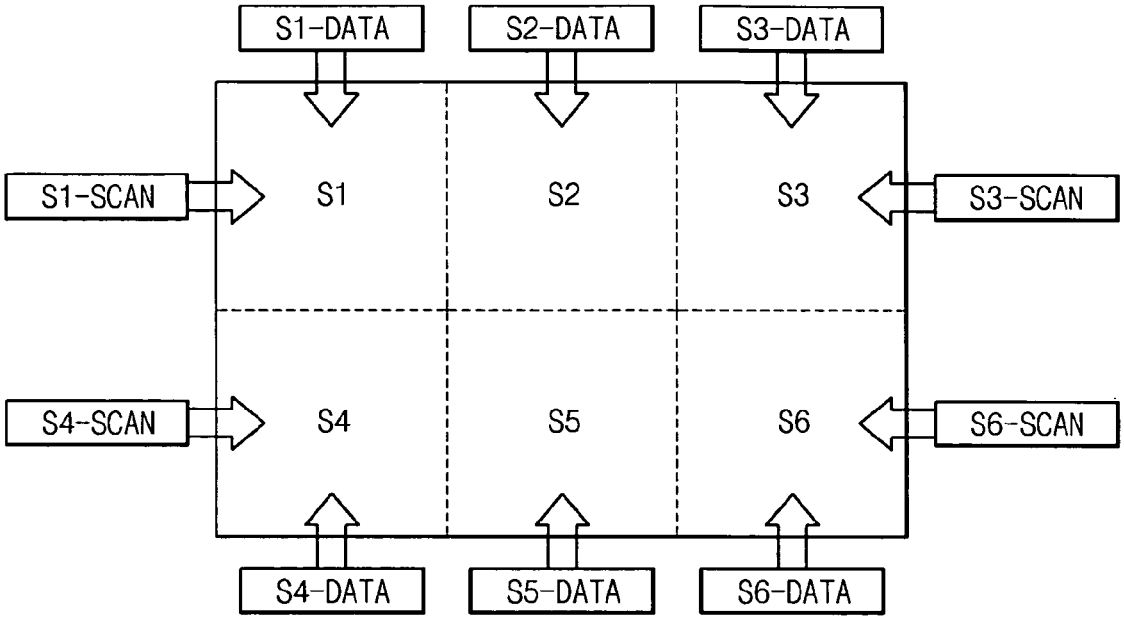
FIG. 2 RELATED ART
FIG. 2 is a conceptual view of an OELD device having a subdivided display area according to the related art.
Figure 3:
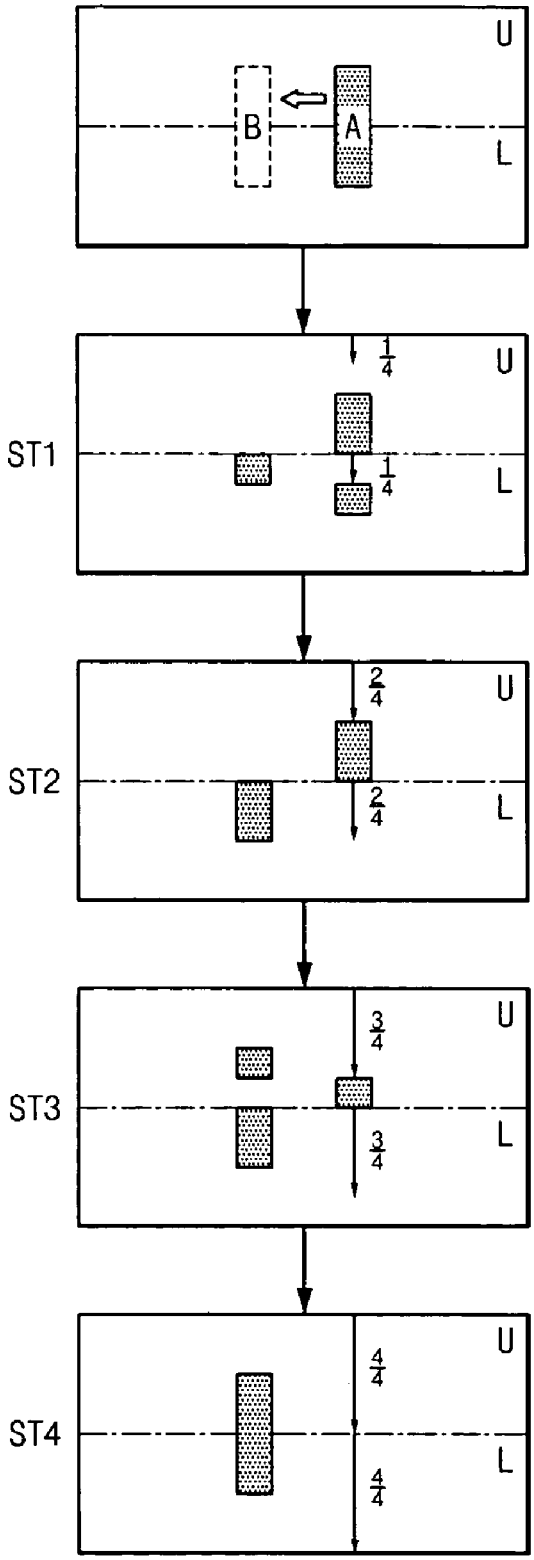
FIG. 3 RELATED ART
FIG. 3 is a progressive view illustrating a method of driving a bifurcated display area of an OELD device according to the related art.
Figure 4:
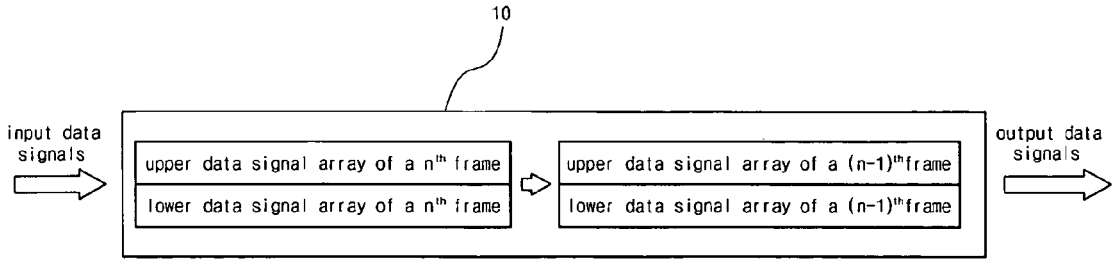
FIG. 4 RELATED ART
FIG. 4 is a block diagram illustrating a transfer flow of data signals in a driving circuit control portion of an OELD device of FIG. 3.

In the exemplary embodiment the two sub-areas are used as an example. However, it should be understood that the present invention is applicable to a plurality of sub-areas and corresponding gate and data driving circuits, as similar to the display device of FIG. 2.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of driving a display device, comprising:

simultaneously first-writing a first data signal array of $n^{th}$ frame data signals and a second data signal array of $(n-1)^{th}$ frame data signals on an upper display area and a lower display area of a display panel during a first frame period, respectively, wherein the first frame period includes first and second steps, the first step ranging between a start point and a third quarter of the first frame period, during which the first step three quarters of the first data signal arrays of the nth frame are written onto the upper display area, and three quarters of the second data signal arrays of the $(n-1)^{th}$ frame are written onto the lower display area, the second step ranging between the third quarter and a fourth quarter of the first frame period, during which the second step a residual fourth quarter of the first data signal arrays of $n^{th}$ frame are written onto the upper display area, and a residual fourth quarter of the second data signal arrays of the $(n-1)^{th}$ frame are written onto the lower display area; and simultaneously second-writing a first data signal array of $(n+1)^{th}$ frame data signals and a second data signal array of the $n^{th}$ frame data signals on the upper display area and the lower display area of the display panel during a second frame period, respectively, consecutively to the first-writing to update the first-written upper and lower display areas through the second-writing, wherein the second frame period includes third and fourth steps, the third step ranging between a start point and a first quarter of the second frame period, during which the third step a first quarter of the first data signal arrays of the $(n+1)^{th}$ frame are written onto the upper display area, and a first quarter of the second data signal arrays of the $n^{th}$ frame are written onto the lower display area, the fourth step ranging between the first quarter and a second quarter of the second frame period, during which the fourth step a second quarter of the first data signal arrays of $(n+1)^{th}$ frame are written onto the upper display area, and a second quarter of the second data signal arrays of the $n^{th}$ frame are written onto the lower display area.

2. The method according to claim 1, wherein each of the first and second data signal arrays are outputted in rows from an upper side to a lower side of each of the upper display area and the lower display area.

3. The method according to claim 1, further comprising extracting the first data signal array of the $n^{th}$ frame data signals from the $n^{th}$ frame data signals and the second data signal array of the $(n-1)^{th}$ frame data signals from the $(n-1)^{th}$ frame data signals, and storing the first data signal array of the $n^{th}$ frame data signals and the second data signal array of the $(n-1)^{th}$ frame data signals in a first memory device.

4. The method according to claim 3, further comprising storing the first data signal array of the $n^{th}$ frame data signals and the second data signal array of the $(n-1)^{th}$ frame data signals in a second memory device prior to storing the first data signal array and the second data signal array in the first memory device.

5. The method according to claim 3, further comprising storing a plurality of first and second data signal arrays in a plurality of first memory devices, wherein the plurality of first and second data signal arrays are sequentially outputted.

6. The method according to claim 1, wherein the display panel is an organic electroluminescent display panel.

7. A display device, comprising:

a display panel having an upper display area and a lower display area; and a driving circuit control portion configured to simultaneously first-write a first data signal array of $n^{th}$ frame data signals and a second data signal array of $(n-1)^{th}$ frame data signals on the upper display area and the lower display area during a first frame period, respectively, and configured to simultaneously second-write a first data signal array of $(n+1)^{th}$ frame data signals and a second data signal array of the nth frame data signals on the upper display area and the lower display area during a second frame period, respectively, consecutively to the first-writing to update the first-written upper and lower display areas through the second-writing, wherein the first frame period includes first and second steps, the first step ranging between a start point and a third quarter of the first frame period, during which the first step three quarters of the first data signal arrays of the nth frame are written onto the upper display area, and three quarters of the second data signal arrays of the $(n-1)^{th}$ frame are written onto the lower display area, the second step ranging between the third quarter and a fourth quarter of the first frame period, during which the second step a residual fourth quarter of the first data signal arrays of $n^{th}$ frame are written onto the upper display area, and a residual fourth quarter of the second data signal arrays of the $(n-1)^{th}$ frame are written onto the lower display area, wherein the second frame period includes third and fourth steps, the third step ranging between a start point and a first quarter of the second frame period, during which the third step a first quarter of the first data signal arrays of the $(n+1)^{th}$ frame are written onto the upper display area, and a first quarter of the second data signal arrays of the $n^{th}$ frame are written onto the lower display area, the fourth step ranging between the first quarter and a second quarter of the second frame period, during which the fourth step a second quarter of the first data signal arrays of $(n+1)^{th}$ frame are written onto the upper display area, and a second quarter of the second data signal arrays of the $n^{th}$ frame are written onto the lower display area.

8. The device according to claim 7, further comprising a plurality of gate lines in the upper display area and the lower display area, the plurality of gate lines in each display area scanned from an upper side to a lower side of the upper display area and the lower display area.

9. The device according to claim 7, wherein the driving circuit control portion includes a first memory device storing the first data signal array of $n^{th}$ frame data signals and the second data signal array of the $(n-1)^{th}$ frame data signals.

10. The device according to claim 9, wherein the driving circuit control portion further includes a second memory device storing the first data signal array of the $(n+1)^{th}$ frame data signals and the second data signal array of the $n^{th}$ frame data signals.

11. The device according to claim 9, further comprising a plurality of first memory devices, disposed to drive a plurality of upper display areas and a plurality of lower display areas.

12. The device according to claim 7, wherein the display panel is an organic electroluminescent display panel.

* * * * *